US011691769B2

(12) United States Patent
Schultz

(10) Patent No.: US 11,691,769 B2
(45) Date of Patent: Jul. 4, 2023

(54) METHOD OF PACKAGING SIDING PANELS

(71) Applicant: CertainTeed LLC, Malvern, PA (US)

(72) Inventor: Ashley A. Schultz, Jackson, MI (US)

(73) Assignee: CERTAINTEED LLC, Malvern, PA (US)

( * ) Notice: Subject to any disclaimer, the term of this patent is extended or adjusted under 35 U.S.C. 154(b) by 0 days.

(21) Appl. No.: 17/526,643

(22) Filed: Nov. 15, 2021

(65) Prior Publication Data

US 2022/0073221 A1 Mar. 10, 2022

Related U.S. Application Data

(62) Division of application No. 16/367,111, filed on Mar. 27, 2019, now Pat. No. 11,198,525.

(60) Provisional application No. 62/651,098, filed on Mar. 31, 2018.

(51) Int. Cl.

| | |
|---|---|
| ***B65B 5/10*** | (2006.01) |
| ***B65D 19/44*** | (2006.01) |
| ***B65D 71/00*** | (2006.01) |
| *B65B 27/02* | (2006.01) |
| *B65B 25/14* | (2006.01) |

(52) U.S. Cl.

CPC ..... *B65B 5/10* (2013.01); *B65D 19/44* (2013.01); *B65D 71/0088* (2013.01); *B65B 5/108* (2013.01); *B65B 25/143* (2013.01); *B65B 27/02* (2013.01); *B65D 2519/0082* (2013.01)

(58) Field of Classification Search

CPC ..... B65B 25/143; B65B 27/02; B65B 5/10; B65B 5/108; B65D 19/44; B65D 2519/0082; B65D 71/0088; B65D 85/46

See application file for complete search history.

(56) References Cited

U.S. PATENT DOCUMENTS

| | | | | |
|---|---|---|---|---|
| 3,415,367 | A * | 12/1968 | Lynch | B65D 71/00 206/321 |
| 5,024,045 | A * | 6/1991 | Fluent | B65B 7/26 53/143 |
| 5,116,191 | A * | 5/1992 | Van | B65D 71/70 414/789.5 |
| 5,862,912 | A * | 1/1999 | Schelhorn | B65D 71/00 206/499 |
| 6,415,574 | B2 | 7/2002 | Beck | |
| 2005/0229548 | A1 | 10/2005 | Hooper | |
| 2011/0042252 | A1* | 2/2011 | Balmer | B65D 85/62 206/321 |
| 2018/0187421 | A1* | 7/2018 | Schultz | E04F 13/0864 |
| 2018/0202166 | A1* | 7/2018 | Culpepper | B32B 27/065 |

(Continued)

OTHER PUBLICATIONS

Copending U.S. Appl. No. 16/367,111, filed Mar. 27, 2019.

*Primary Examiner* — Andrew M Tecco

*Assistant Examiner* — Nicholas E Igbokwe

(74) *Attorney, Agent, or Firm* — McDonnell Boehnen Hulbert & Berghoff LLP

(57) ABSTRACT

One aspect of the disclosure is a method of packaging a plurality siding panels. The method includes providing a plurality of siding panels, each siding panel having a front face, a rear face, top edge, a bottom edge, and a support member secured to the rear face, placing a first siding panel vertically within a box, the box having a first side, a second side, a top side, and a bottom side, and placing a second siding panel vertically within the box next to the first siding panel.

18 Claims, 5 Drawing Sheets

(56) References Cited

U.S. PATENT DOCUMENTS

| | | | | |
|---|---|---|---|---|
| 2020/0141125 | A1* | 5/2020 | O'Neal | E04F 13/0803 |
| 2020/0263435 | A1* | 8/2020 | Olvey | B32B 21/08 |

* cited by examiner

METHOD OF PACKAGING SIDING PANELS

CROSS-REFERENCE TO RELATED APPLICATIONS

This application is a divisional of U.S. patent application Ser. No. 16/367,111, which claims the benefit of priority of U.S. Provisional Patent Application No. 62/651,098, each of which is hereby incorporated herein by reference in its entirety.

BACKGROUND OF THE DISCLOSURE

1. Field of the Disclosure

The present disclosure relates generally to siding panels. The present disclosure relates more particularly to a method of packaging siding panels.

2. Technical Background

Vinyl siding is commonly used in construction as the exterior cladding for homes and other structures, and has the advantage of low maintenance, easier installation, and high resistance to weathering when compared to wood or composite siding. Vinyl siding is easily applied by home remodelers and do-it-yourselfers. Adjacent panels are overlapped side by side along a surface, creating a number of "lapped" areas once installed. Ideally, the "lap appearance" should not be noticeable, and should remain so over time. However, defects or damage to the siding panels prior to installation can lead to poor lap appearance both initially and over time. For example, due to the undistributed weight and low rigidity of the panels, short or long term creep deformation can occur when the panels are stacked together, which is when areas of the panels sag and, over time, create permanent deformation.

Some vinyl panels are backed with an insulating member to provide additional rigidity to the thin panels as well as provide insulation to the surface to which they are being applied. These panels generally have a thicker overall profile or projection off of the surface to which they are applied in order to provide sufficient insulation, and thus look and function similar to composite siding. Therefore, the insulating member extends beyond the top edge of the siding panel to provide a continuous layer of insulation between panels and minimize gaps. In order to provide the desired wide, flat face look of wood siding in vinyl, these insulated vinyl siding panels can be made with wider profiles without heat distortion issues due to the attached support member. The thicker projection panels generally do not have creep deform issues when stacked horizontally since the support member provides enough additional reinforcement to the wide panels to prevent it.

To further provide vinyl siding with a more updated and sophisticated look as seen in composite siding, and to standardize sizing, another type of vinyl siding panel can include a support member that serves to reinforce the thin panel, but does not extend to or past the top edge of the panel. These panels provide the low-profile, thinner projection look of composite siding and are referred to as reinforced panels, since the main purpose of the support member is for reinforcement rather than insulation.

The shape of the profile of the vinyl siding panels (i.e., non-uniform shape, thin plastic, exposure to wide range of temperatures in storage (job sites), etc.) complicates packaging of the panels in stacks within a box or carton. Since the panels are manufactured in a horizontal orientation, for ease of packaging, the panels are normally horizontally stacked within the box in alternate orientation. A plurality of boxes is then placed on a pallet. However, the horizontally stacked orientation of reinforced siding panels within the box can lead to creep deformation of the panels.

SUMMARY OF THE DISCLOSURE

One aspect of the disclosure is a method of packaging a plurality of siding panels comprising:

providing a plurality of siding panels, each siding panel having a front face, a rear face, top edge, a bottom edge, and a support member secured to the rear face;

placing a first siding panel vertically within a box, the box having a first side, a second side, a top side, and a bottom side; and placing a second siding panel vertically within the box next to the first siding panel.

In certain embodiments, sixteen (16) siding panels are oriented within a box.

Another aspect of the disclosure is a container for packaging siding panels as described herein. The container comprises:

a first side, a second side opposite the first side, a top side, and a bottom side; and a plurality of siding panels oriented vertically within the container, wherein each siding panel includes a front face, a rear face, top edge, a bottom edge, and a support member secured to the rear face.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

The present inventor has noted disadvantages of conventional methods of packaging siding panels. Generally, a plurality of vinyl siding panels with an attached support member are stacked horizontally on top of one another within a box or carton for shipping and/or distribution. When placed in the box, the siding panels are stacked on top of one another with a front face of one siding panel abutting a front face of an adjacent siding panel. In this configuration, eight (8) siding panels can fit within the box. In other embodiments with other siding profiles, a different number of panels may fit in a box.

Additionally, a plurality of the boxes are arranged on a pallet or skid for shipping and/or loading onto a truck or other transportation methods. Generally, a pallet holds nine (9) boxes of siding panels which are stacked horizontally within the boxes. Thus, seventy-two (72) siding panels can be held on a pallet. The boxes may be held together on the pallet by one or more straps.

However, as mentioned above, horizontally stacking certain siding panels within the box can cause areas of the panels to sag due to the uneven weight distribution. The present inventor has noted that placing the siding panels vertically within the box can lead to increased quality of the siding panels before and after installation, as well as better overlap appearance during initial installation, as well as after being exposed to extreme temperature conditions.

Accordingly, one aspect of the disclosure is a method for packaging a plurality of siding panels vertically within a shipping box. The method may provide placing a first siding panel vertically within a box, and placing a second siding panel vertically within the box next to the first siding panel. In certain embodiments as otherwise disclosed herein, sixteen (16) siding panels are positioned within one box.

Figure 1:
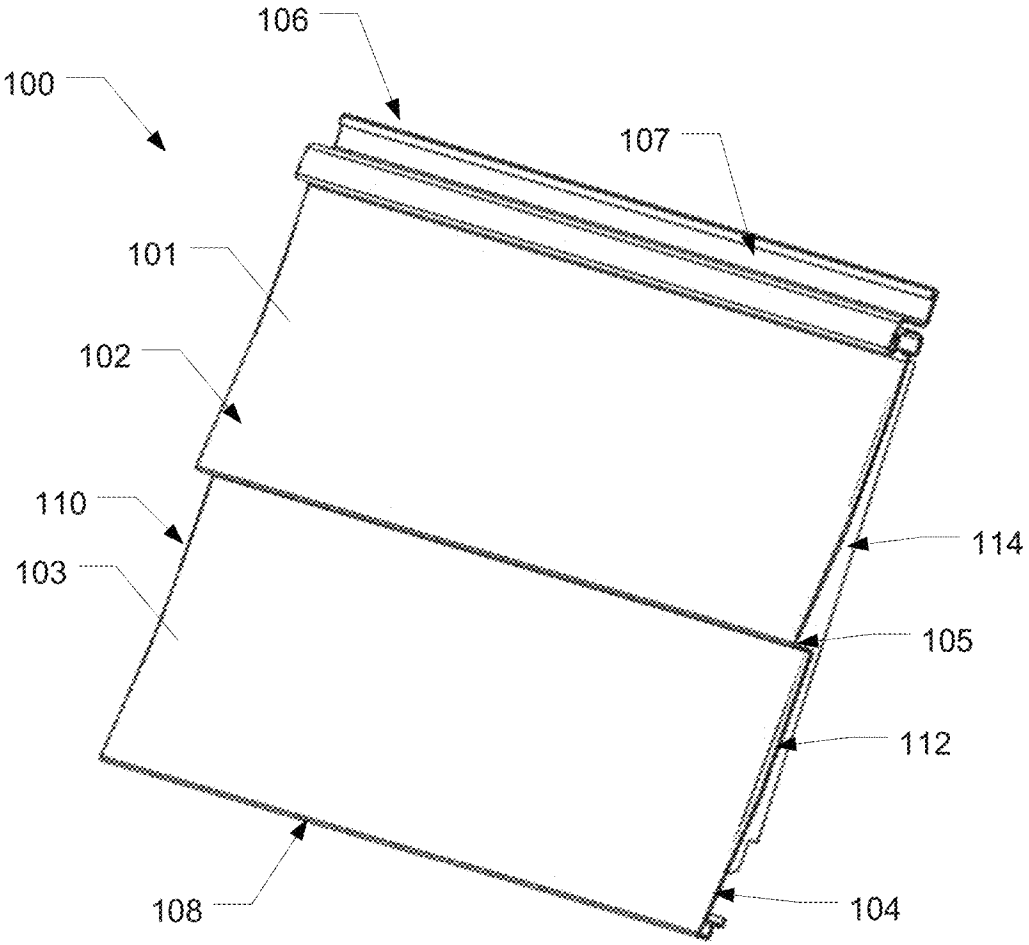
FIG. 1 is a schematic perspective view of an example siding panel according to one embodiment of the disclosure.
Figure 2:
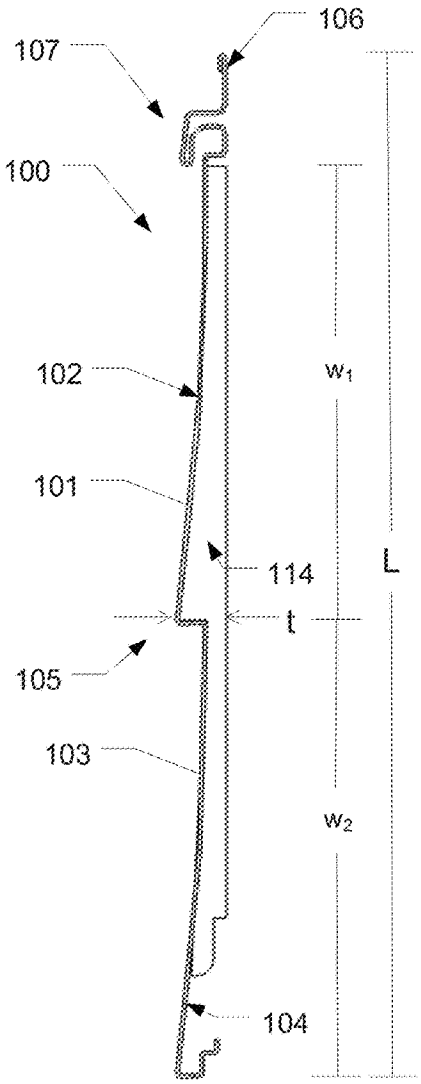
FIG. 2 is a schematic side view of the siding panel shown in FIG. 1

One embodiment of such a method is described with respect to FIGS. 1-3 below. FIGS. 1-2 show an example siding panel 100. In some embodiments, the siding panel is a vinyl siding panel which is interlocked and overlapped with one or more adjacent vinyl siding panels. As shown in FIG. 1, the siding panel 100 may comprise a front face 102 and a rear face 104, opposite the front face. The front face 102 has an upper region 101 and a lower region 103, separated by an abutment 105. In some embodiments, as shown in FIG. 2, the width $w_1$ of the upper region 101 is in the range of about 2 in. to about 10 in., for example. In some embodiments, the width $w_2$ of the lower region 103 is in the range of about 2 in. to about 10 in., for example. In certain embodiments as otherwise described herein, the siding panel can have more or less regions having various widths. Additionally, the abutment 105 is smaller than that of standard vinyl siding, such as from about 3/16 in. to about 7/16 in., which provides an updated look and allows the support member to be thinner (described below).

The siding panel 100 further includes a top edge 106 and a bottom edge 108 opposite the top edge. As shown in FIGS. 1 and 2, the top edge 106 includes a nail hem 107 for receiving one or more fasteners to fasten the siding panel 100 to a surface. The nail hem 107 is interlocked with and concealed by the next higher course of siding. The siding panel 100 also includes a first side edge 110 and a second side edge 112, opposite the first side edge. It should be understood that although the first side 110 is shown as being on the left side of the panel 100 and the second side 112 is shown as being on the right side of the panel, the first side and second side could be reversed.

Referring again to FIG. 1, a reinforcing or support member 114, such as a piece of foam, is secured to the rear face 104. The support member 114 provides support and rigidity to the siding panel 100 to prevent deformation, as well as to support wider regions 101, 103, which provide a more sophisticated overall appearance. The support member 114 is secured along a portion of the length L of the siding panel 100, shown in FIG. 2. For example, in some embodiments, the support member 114 may have a length of about 2 in. to about 24 in. In certain embodiments as otherwise disclosed herein, the support member 114 extends from about 1/4 in. to about 5 in. away from the top edge 106. In certain embodiments, the support member 114 extends from about 0 in. to about 6 in. away from the bottom edge 108. Alternatively, in some embodiments, the support member 114 may be secured along the entire length L of the siding panel, or beyond the length L of the siding panel. In some embodiments, the support member 114 may have a thickness tat its largest section of about 1/8 in. to about 3/4 in.

In certain embodiments as otherwise described herein, the support member 114 is secured to the rear face 104 of the siding panel 100 with an adhesive. It should be understood that any suitable fastening mechanism may be used to secure the support member to the rear face 104. For example, in some embodiments, the support member 114 is fused to, poured onto, co-extruded, laminated, welded, mechanically joined, or injection molded onto the rear face 104 of the siding panel 100.

Figure 3:
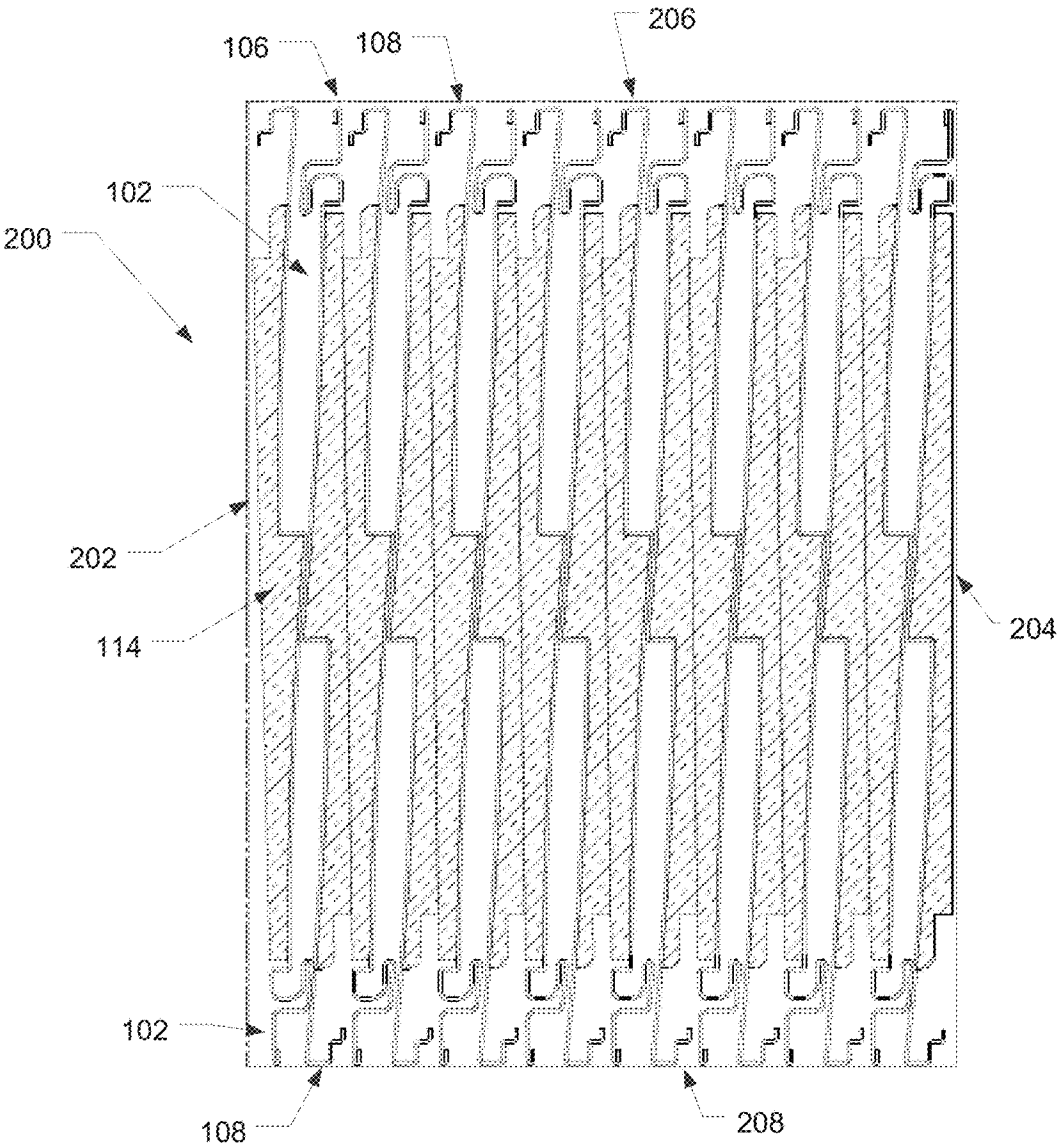
FIG. 3 is a schematic front view of a plurality of siding panels as shown in FIG. 1 packaged vertically within a box.

FIG. 3 shows a plurality of siding panels 100 vertically packaged within a box or carton 200. The box has a first side 202, a second side 204 opposite the first side, a top side 206 and a bottom side 208. Generally, each box 200 is 1 square, or 100 $ft^2$. In some embodiments, the first and second sides 202, 204 of the box may have a length in the range of about 4 inches to about 26 inches. In some embodiments, the top and bottom sides 206, 208 of the box may have a length in the range of about 2 inches to about 48 inches. To ensure the stability of the box, the height to width ratio should be less than 1.5. That is, the width of the bottom side 208 of the box should have a length of at least 2/3 the length of the sides 202, 204 of the box. The lower the height to width ratio, the better the stability of the box.

The siding panels 100 are oriented within the box 200 so that the top and bottom edges 106, 108 of the siding panels abut or are adjacent to the top and bottom sides 206, 208 of the box 200. Additionally, the siding panels 100 are placed within the box 200 so that the support member 114 of a panel abuts or is adjacent to each of the first side 202 and the second side 204 of the box 200. Between the outermost siding panels, the siding panels are arranged such that a front face 102 of one siding panel is positioned adjacent a front face 102 of a second siding panel, as shown in FIG. 3. Furthermore, a support member 114 of one siding panel is positioned adjacent or abutting a support member of a second siding panel.

As noted above, the vertical orientation of the packaging allows for sixteen (16) siding panels 100 to fit within a box 200, which is double the amount of siding panels in a box than when placed in a horizontal orientation. In other embodiments with other siding profiles, a different number of panels may fit in a box. Thus, the packaging method of the present application enables more panels can fit within a single box, which allows more panels to fit on a pallet, and therefore more panels to fit on a vehicle for transport, leading to a more efficient packaging and transport system for the siding panels. In this way, the shipped boxes will also take up less space in a buyer's warehouse, allowing the purchase of more product at once, and also enabling the storage more product in the same amount of space (have more on hand for customers).

Figure 4:
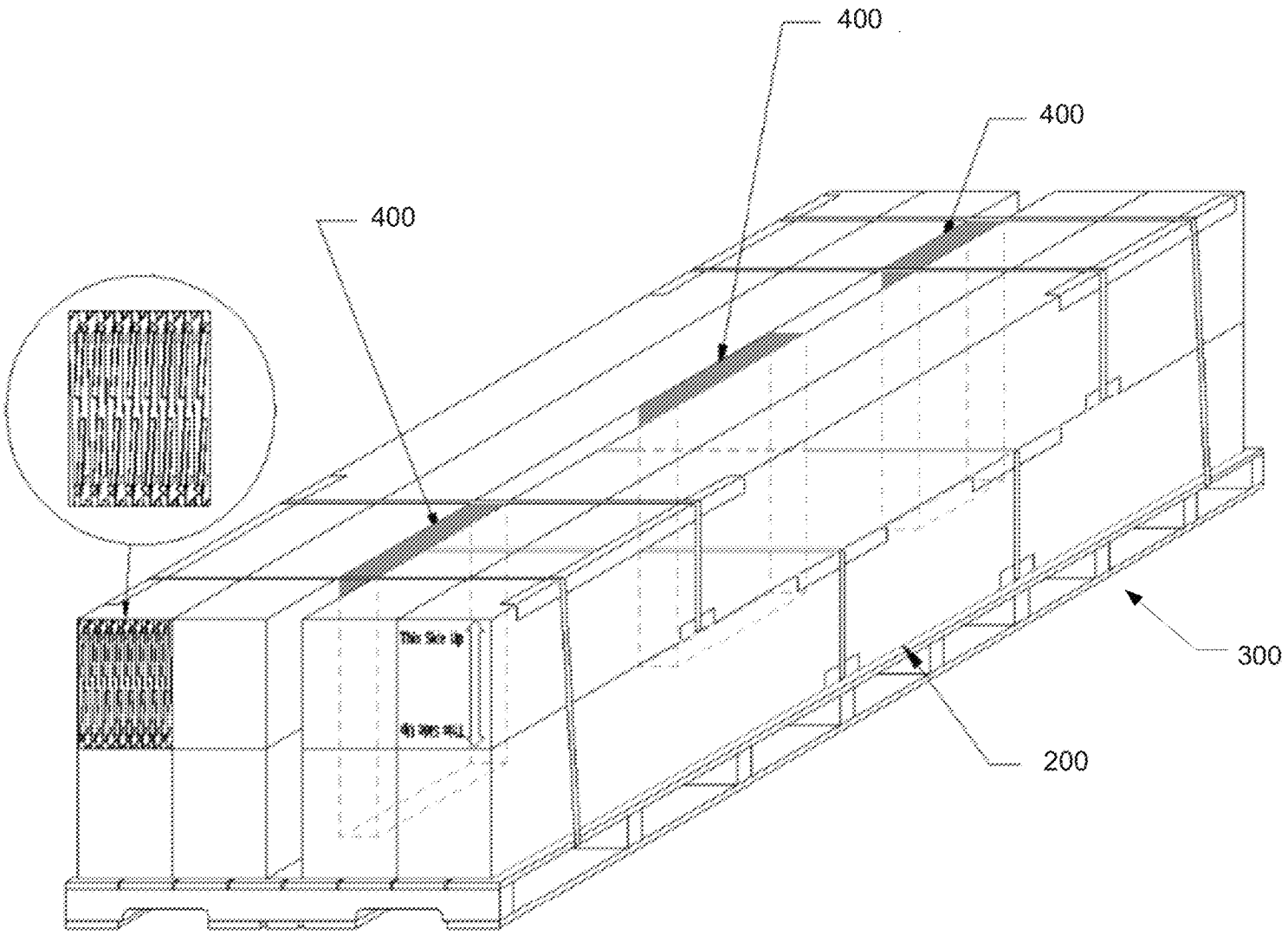
FIG. 4 is a schematic perspective view of a pallet of boxes of siding panels packaged as shown in FIG. 3.

FIG. 4 shows one embodiment of a pallet or skid 300 including eight (8) boxes 200 having siding panels 100 oriented vertically within each box. Thus, one hundred and twenty-eight (128) siding panels can fit on a single pallet 300, as compared to only seventy-two (72) panels on a pallet when packaged horizontally within the box. As mentioned above, the vertical orientation leads to a more efficient packaging and transport system for the siding panels, while preserving the quality of the panel appearance by reducing the amount of sag or deformation experienced during the transport process. Moreover, since the siding panels 100 are thinner than traditional siding with a support member, due in part to the smaller thickness t of the support member 114, the panels 100 take up less volume within the box 200. Since there are weight limits for pallets, the lighter panels can also lead to an increase in the amount of panels that can fit on a pallet. Furthermore, the arrangement of the boxes more completely utilizes the space on the top of the pallet.

Additionally, spacers 400, such as foam spacers may be placed between the boxes 200 and the edges of the pallet 300 to stabilize the boxes and assist in evening out the load on pallet. In some embodiments, 3 spacers may be placed on the pallet 300. In certain embodiments as otherwise disclosed herein, more or less spacers may be used.

Figure 5:
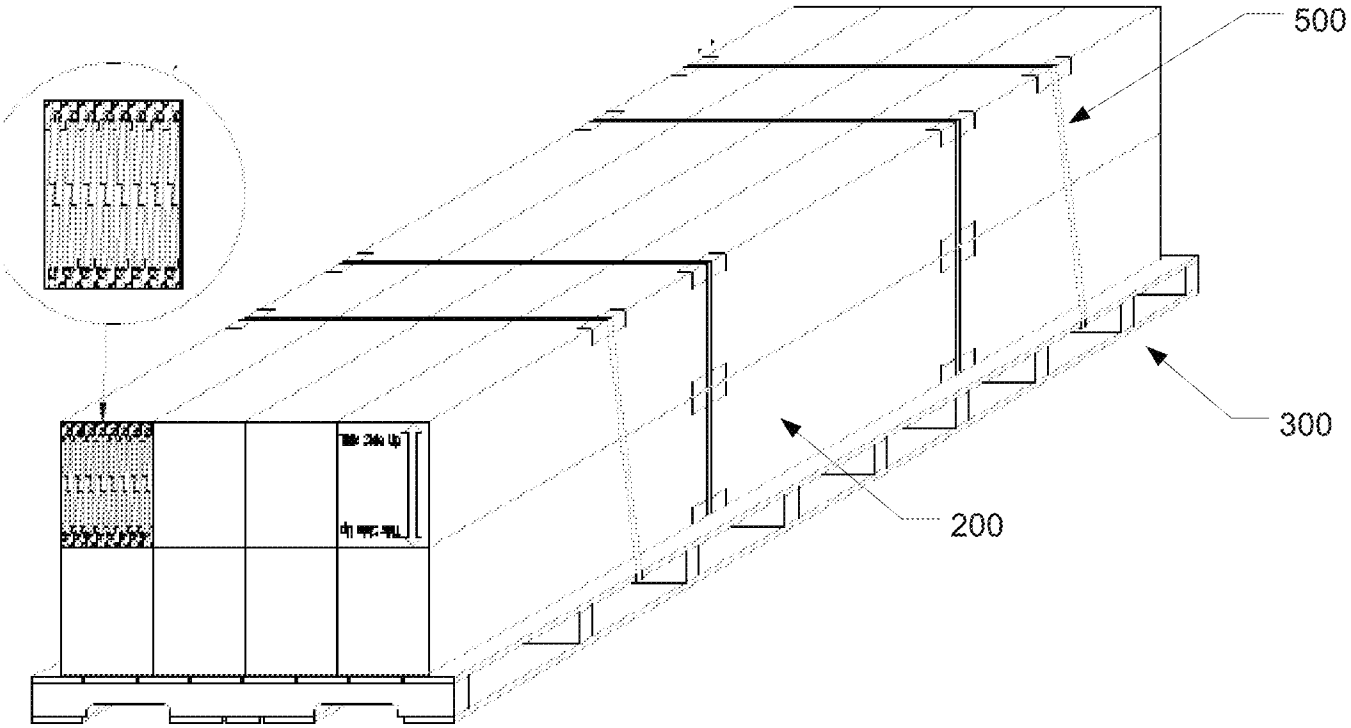
FIG. 5 a schematic perspective view of another embodiment of a pallet of boxes of siding panels packaged as shown in FIG. 3.

FIG. 5 shows another embodiment of a pallet 300 including eight (8) boxes 200 having siding panels 100 oriented vertically within each box. In this embodiment, the boxes 200 are stabilized on the pallet by one or more straps 500 which secure the box to the pallet by being placed through an interior region 302 of the pallet 300.

Figure 6:
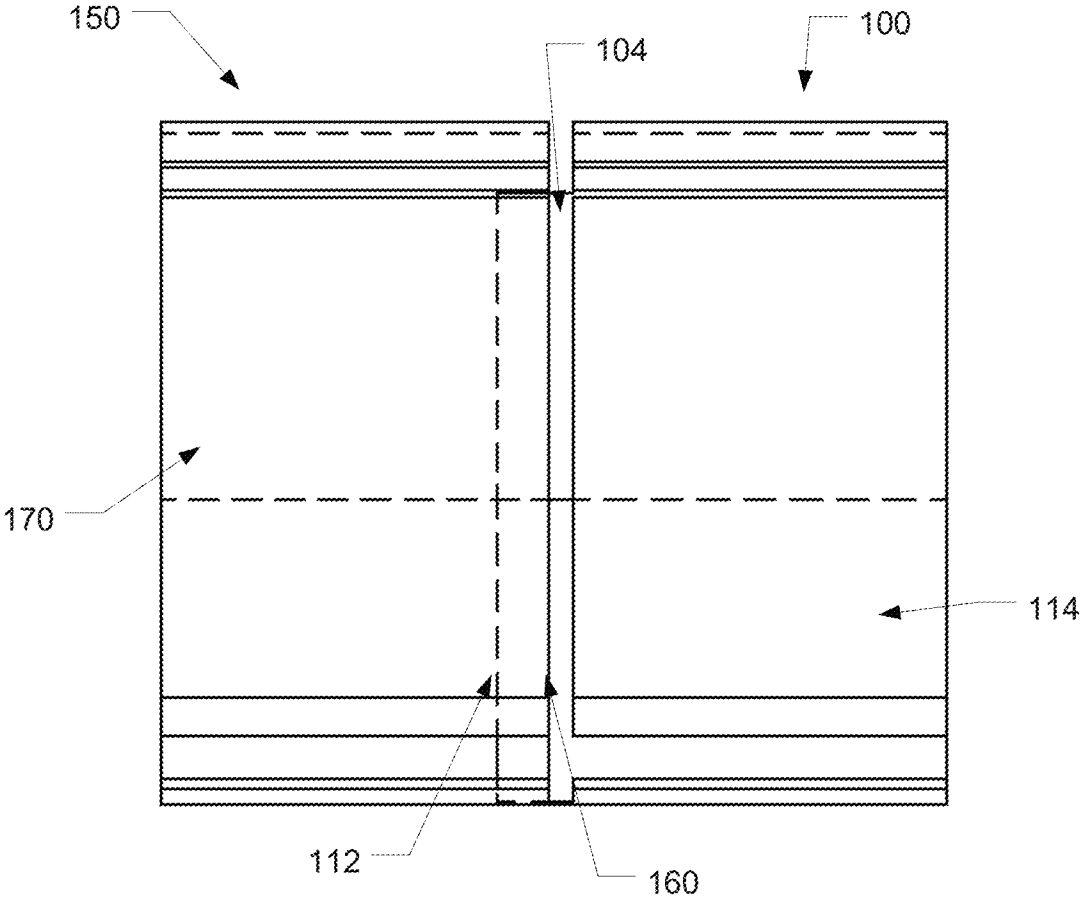
FIG. 6 is a schematic rear view of two siding panels being overlapped together.

As shown in FIG. 6, during installation, two adjacent siding panels 100, 150 are overlapped at their side edges. Specifically, the second edge 112 of the first panel 100 is overlapped with the first edge 160 of the second panel 150. The support member 170 of the second panel 150 extends all the way to the first edge 160, and fits over the rear face 104 of the first panel 100. Since the support members extend all the way to one edge of the panel, the panels can only be overlapped in one direction. Once overlapped, the panels can be secured to the surface by any suitable fastener, such as by nailing the panels to the surface. The same method can be repeated for each additional panel.

Notably, testing has shown that the vertically packaged siding panels will not creep deform, and therefore have a better initial lap appearance, as well as a better lap appearance over time and when exposed to extreme temperatures than the same siding panels when packaged horizontally.

In various embodiments as otherwise described herein, the support member 114 may be made of any conventional material that can provide rigidity to the siding panel 100. For example, the support member 114 may be made of foam, fiber, mesh, acrylic, polymer, polymer composite, metal, wood, rubber, mineral-filled material, composite material, or combinations thereof. In some embodiments, the support member 114 can be made of any material not susceptible to moisture absorption. In certain embodiments, the support member 114 may be made of any material having a coefficient of linear expansion similar to the coefficient of linear expansion of vinyl, or of whatever material the siding panel itself is made.

It should be understood that the siding panels disclosed herein can be made by any known method, such as a known extrusion process, with a common panel size of 8 inches wide by 12 feet long, although other lengths and widths can be used as appropriate.

As the person of ordinary skill in the art will appreciate, the siding panels disclosed herein may be made of conventional materials. For example, the siding panels may be constructed of vinyl, PVC, polymer, polypropylene, acrylic, Acrylonitrile Styrene Acrylate (ASA), fiberglass, aluminum, steel, any other plastic, or metal, or combinations thereof, or any other material that requires the siding panels to overlap during installation. Conventional methodologies for siding construction can be used in the siding panels as described herein.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A package of siding panels, the package comprising:

a container comprising a first side, a second side opposite the first side, a top side, and a bottom side; and a plurality of siding panels, wherein each siding panel includes a front face, a rear face, top edge, a bottom edge, and a support member secured to the rear face, with a top edge to bottom edge axis of each siding panel being oriented vertically, and wherein the plurality of siding panels includes a plurality of first siding panels and a plurality of second siding panels in an alternating arrangement, wherein each of the first siding panels is oriented such that the top edge of each first siding panel is disposed toward the top side of the container and the bottom edge of the first siding panel is disposed toward the bottom edge of the container, and wherein each of the second siding panels is oriented such that the top edge of each second siding panel is disposed toward the bottom side of the container and the bottom edge of each second siding panel is disposed toward the top side of the container.

2. The package of claim 1, wherein the front face of each of the first siding panels is oriented facing the front face of an adjacent second siding panel.

3. The package of claim 1, wherein the dimensions of the container are 4 in. to 26 in. by 2 in. to 48 in.

4. The package of claim 1, wherein in each of the siding panels the support member has a length of 2 in. to 24 in.

5. A unit of packages of siding panels, the unit comprising a pallet or skid, and disposed on the pallet or skid, eight (8) of the packages as claimed in claim 1, oriented such that a top side to bottom side axis of each package is oriented vertically on the pallet or skid.

6. A unit of packages of siding panels, the unit comprising a pallet or skid, and disposed on the pallet or skid, a plurality of the of the packages of siding panels as claimed in claim 1, oriented such that a top side to bottom side axis of each package is oriented vertically on the pallet or skid.

7. The unit of packages of siding panels of claim 6, wherein the plurality of packages consists of from eight to thirty containers.

8. The unit of packages of siding panels of claim 6, further comprising spacers arranged on each side of the pallet or skid.

9. The unit of packages of siding panels of claim 6, wherein one hundred and twenty-eight (128) siding panels are disposed in the packages on the pallet or skid.

10. The unit of packages of siding panels of claim 6, wherein from thirty (30) to three hundred and fifty (350) siding panels are disposed in the packages on the pallet or skid.

11. The package of claim 1, wherein from four (4) to forty (40) siding panels are disposed in the container.

12. The package of claim 1, wherein in each siding panel the support member is secured along at least a portion of a length of the siding panel.

13. The package of claim 1, wherein in each siding panel the support member has a length of 2 in. to 24 in.

14. The package of claim 1, wherein in each siding panel the front face of the siding panel comprises an upper region and a lower region.

15. The package of claim 14, wherein in each siding panel the width of the upper region is in the range of 2 in. to 10 in and the width of the lower region is in the range of 2 in. to 10 in.

16. The package of claim 1, wherein in each siding panel the support member is constructed of a material having a coefficient of linear expansion similar to the coefficient of linear expansion of the material the siding panel.

17. The package of claim 1, wherein the container is a box.

18. A unit of packages of siding panels, the unit comprising a platform, and a plurality of the of the packages of siding panels as claimed in claim 1, oriented such that a top side to bottom side axis of each package is oriented vertically on the platform.

* * * * *